US005370302A

United States Patent [19]

Dyer

[11] Patent Number: 5,370,302

[45] Date of Patent: Dec. 6, 1994

[54] TWO WAY SEALER POSTCARD

[75] Inventor: Michael C. Dyer, Lake Zurich, Ill.

[73] Assignee: Moore Business Forms, Inc., Grand Island, N.Y.

[21] Appl. No.: 98,788

[22] Filed: Jul. 29, 1993

[51] Int. Cl.[5] ..... B42D 15/04

[52] U.S. Cl. ..... 229/92.8; 156/291; 229/92.1; 229/300; 493/325

[58] Field of Search ..... 229/92.8, 92.1, 300; 156/291; 493/325

[56] References Cited

U.S. PATENT DOCUMENTS

| | | | |
|---|---|---|---|
| 195,974 | 10/1877 | Brooks . | |
| 263,347 | 8/1882 | Mead | 229/92.8 |
| 339,889 | 4/1886 | Homan . | |
| 576,552 | 2/1897 | Cook | 229/92.8 |
| 894,124 | 7/1908 | Draemel . | |
| 961,829 | 6/1910 | Woolridge . | |
| 1,264,795 | 4/1918 | Hill | 229/92.8 |
| 1,957,374 | 5/1934 | Unger . | |
| 2,074,821 | 3/1937 | Wissmann . | |
| 2,168,920 | 8/1939 | Wissmann . | |
| 2,324,777 | 7/1943 | Holstrom | 229/92.8 |
| 2,805,816 | 9/1957 | Morgan . | |
| 3,329,333 | 7/1967 | Ormond . | |
| 3,380,648 | 4/1968 | DeLyra . | |
| 3,523,638 | 8/1970 | Moonan . | |
| 3,899,127 | 8/1975 | Melander . | |
| 4,784,317 | 11/1988 | Chen et al. . | |
| 4,872,705 | 10/1989 | Hartfeil | 229/92.8 |
| 4,877,177 | 10/1989 | Felix . | |
| 4,892,246 | 1/1990 | Norman . | |
| 4,938,414 | 7/1990 | Lippert | 229/92.8 |
| 5,085,470 | 2/1992 | Peach et al. | 229/92.8 |
| 5,118,031 | 6/1992 | Tighe | 229/92.8 |
| 5,207,373 | 5/1993 | Tighe | 229/92.8 |

*Primary Examiner*—Stephen P. Garbe
*Attorney, Agent, or Firm*—Nixon & Vanderhye

[57] ABSTRACT

A postcard mailer may also be used as a reply postcard. A sheet of paper between one-half of and the minimum weight of a postcard, is printed with reply and return address indicia on the top face of one side of an intermediate fold line, while the sheet on the other side of the fold line is printed with instructional or inquisitive indicia. A removable label printed with outgoing address indicia is disposed over the reply address indicia. A line of weakness parallel to the top edge defines the sheet into first and second panels, the second panel having at least the minimum dimensions of a postcard. Adhesive patterns are provided on the bottom face of the sheet, on both the first and second panels. The sheet is folded about an intermediate fold line and the adhesive is sealed, producing an outgoing postcard. By detachment at the line of weakness, and removing the label, the mailer is transformed into a reply postcard.

23 Claims, 2 Drawing Sheets

TWO WAY SEALER POSTCARD

BACKGROUND AND SUMMARY OF THE INVENTION

There are substantial cost savings associated with the use of postcards for mailers. However where postcards used for mailers are designed to have a reply, they are typically constructed with one outgoing card and one return card, comprising two separate panels both of postcard weight. Post Office regulations require that a mailing piece serving as a postcard have a particular weight (pounds per surface area). This is a limiting factor on being able to use postcards for mailers with reply pieces from the cost standpoint. Also, this limits the types of printers with which such cards can be utilized, and makes their use more difficult.

According to the present invention, the drawbacks of conventional postcards used as mailers with reply pieces have been overcome by providing one lightweight sheet (e.g. 24 pounds per roll ledger paper) which is folded over. The weight of the paper utilized according to the invention is at least half of the minimum postcard weight, but less than normal postcard weight, so that when it is folded over it has the appropriate postcard weight. Utilizing the construction according to the invention it is possible to print on a simplex conventional printer what ends up to be both the front and back of the mailer/postcard. The construction according to the invention also allows detachment of a stub portion which contains the reply address, so that the remaining portion still has the minimum size and weight for a postcard, and allows a postcard reply to be provided, saving substantial postage both ways in addition to the advantages described above.

According to one aspect of the present invention, an intermediate for a postcard mailer is provided. The intermediate comprises the following elements: A sheet of paper having a weight less than the weight of a postcard, but at least half the weight of a postcard, having first and second faces, and having parallel top and bottom edges, and parallel first and second side edges, the length of each of the side edges being longer than the minimum width of a postcard, and the length of each of the top and bottom edges being at least twice the minimum length of a postcard. A fold line parallel to the side edges and substantially bisecting the top and bottom edges. A line of weakness parallel to the top and bottom edges and located closer to the top edge than the bottom edge to define a first panel between the top edge and the line of weakness, and a second panel between the bottom edge and the line of weakness, the first panel having a width large enough to have return address indicia or postage provided and readily legible thereon, and the second panel having a width at least as great as the minimum width of a postcard. A first adhesive pattern provided on the second face of the first panel for holding the top and side edges of the first panel together when the sheet is folded about the fold line. And, a second adhesive pattern provided on the second face of the first panel for holding the top, side, and bottom edges of the second panel together when the sheet is folded about the fold line, even if the first panel is removed by detachment along the line of weakness.

Tractor drive holes may be provided along the side edges, the length of the top and bottom edges minus the widths of both set of tractor drive holes being at least as great as the minimum length of a postcard. The tractor drive holes typically are slit off prior to the construction of the final mailer.

Outgoing address indicia may be imaged on the second panel first face on a first side of the fold line, typically on a removable label, with reply address indicia imaged directly on the first face of the second panel beneath the removable label. Return address indicia is imaged on the first panel first face on the first side of the fold line while instructional indicia, for instructing the recipient of the postcard mailer made from the intermediate how to use the mailer as a reply postcard is imaged on the first panel first face on a second side of the fold line opposite the first side.

The first adhesive pattern may comprise a strip of heat seal adhesive along the top edge on a first side of the first fold line and along the first side edge in the first panel. The second adhesive pattern may comprise a continuation of the adhesive pattern along the first side edge into the second panel, and first and second strips of heat seal adhesive adjacent the bottom edge and the line of weakness in the second panel, and parallel to the bottom edge. The first and second strips of adhesive on the second panel second face typically are on a second side of the fold line opposite the first side.

The intermediate may also have first and second indicia portions indicating where postage should be placed, the first indicia portion on the first panel first face on the first side of the fold line, and next to the fold line, and the second indicia portion immediately below the first indicia portion in the second panel. Informational or inquisitive indicia may be imaged on the first face of the second panel on the second side of the fold line.

The invention also comprises a postcard mailer. The postcard mailer according to the invention has the following elements: A first ply having a length and width at least equal to the minimum length and width of a postcard, and a weight at least one half the minimum weight of a postcard, but less than the minimum postcard weight; and having parallel top and bottom edges and parallel first and second side edges. A second ply having a length and width substantially equal to that of the first ply, and a weight at least one half the minimum weight of a postcard; and having top, bottom, and side edges substantially in alignment with the corresponding edges of the first ply. A line of weakness extending parallel to the top edge and defining the plies into first and second panels, a first panel of each ply between the top edge and the line of weakness, and a second panel of each ply between the line of weakness and the bottom edge, the second panel having at least a postcard minimum length and width. Means for holding the first panel of the first ply to the first panel of the second ply, and means for holding the second panels of the first and second plies together independent of the first panels. A removable label having outgoing address indicia imaged thereon disposed on the top face of the first ply second panel. Reply address indicia underneath the label, and exposed when the label is removed. And, return address indicia on the first face of the first ply first panel.

Typically informational or inquisitive indicia are provided on the bottom face of the second ply second panel, and instructional indicia is provided on the bottom face of the second ply first panel. Postage placement indicia may be provided on both the top face of the first ply adjacent a right side edge thereof on opposite sides of the line of weakness.

The means for holding the plies together typically comprises a first adhesive pattern acting between the first panels of the bottom face of the top ply and the top face of the bottom ply, and a second adhesive pattern acting between the second panels of the bottom face of the top ply and the top face of the bottom ply. The reply address indicia typically is imaged directly on the top face of the first ply beneath the removable label.

According to a third aspect of the present invention a method of making a postcard mailer from a sheet of paper is provided. The paper has leading and trailing edges and side edges, and particular weight, length, and width dimensions. The method comprises the following steps: (a) Providing a fold line in the sheet substantially bisecting the leading and trailing edges, and parallel to the side edges. (b) Imaging reply address indicia and return address indicia on the top face on a first side of the fold line, and imaging informational or inquisitive indicia on the top face on a second side of the fold line, opposite the first side. (c) Providing a line of weakness in the sheet parallel to the leading and trailing edges and defining each side of the fold line into first and second panels, the first panel on the first side having the return address indicia imaged thereon, and the second panel on the first side having the reply address information imaged thereon, and the second ply on the second side having the informational or inquisitive indicia imaged thereon. (d) Providing first and second patterns of adhesive on the bottom face of the first and second panels, respectively. (e) Imaging an outgoing address on a removable label. (f) Placing the removable label over the reply address. (g) Subsequent to steps (a), (b), and (d), folding the sheet about the fold line to bring the bottom faces of the panels on the opposite sides of the fold lines into engagement with each other. And, (h) sealing the adhesive of the adhesive patterns to form an outgoing postcard which may be transformed into a reply postcard by tearing along the line of weakness and removing the label.

The sheet may be part of a continuous form, having tractor drive openings along the side edges thereof. In that case there are the further steps of slitting off the tractor drive opening portions along the side edges, and separating the sheet from the continuous form at the leading and trailing edges thereof. Step (b) may be further practiced to image instructional indicia telling the recipient how to use the mailer as a return postcard, on the top face of the first panel on the second side of the fold line. Step (b) may also be further practiced to image postcard-receiving indicating indicia on the top face of the first side of the fold line on both the first and second panels, immediately adjacent the line of weakness.

It is the primary object of the present invention to provide for the advantageous construction of a postcard mailer, having a postcard as a reply element too without requiring the use of two postcard sheets, and allowing great versatility in printing what ultimately becomes the front and back of the postcard. This and other objects of the invention will become clear from an inspection of the detailed description of the invention, and from the appended claims.

DETAILED DESCRIPTION OF THE DRAWINGS

Figure 1:
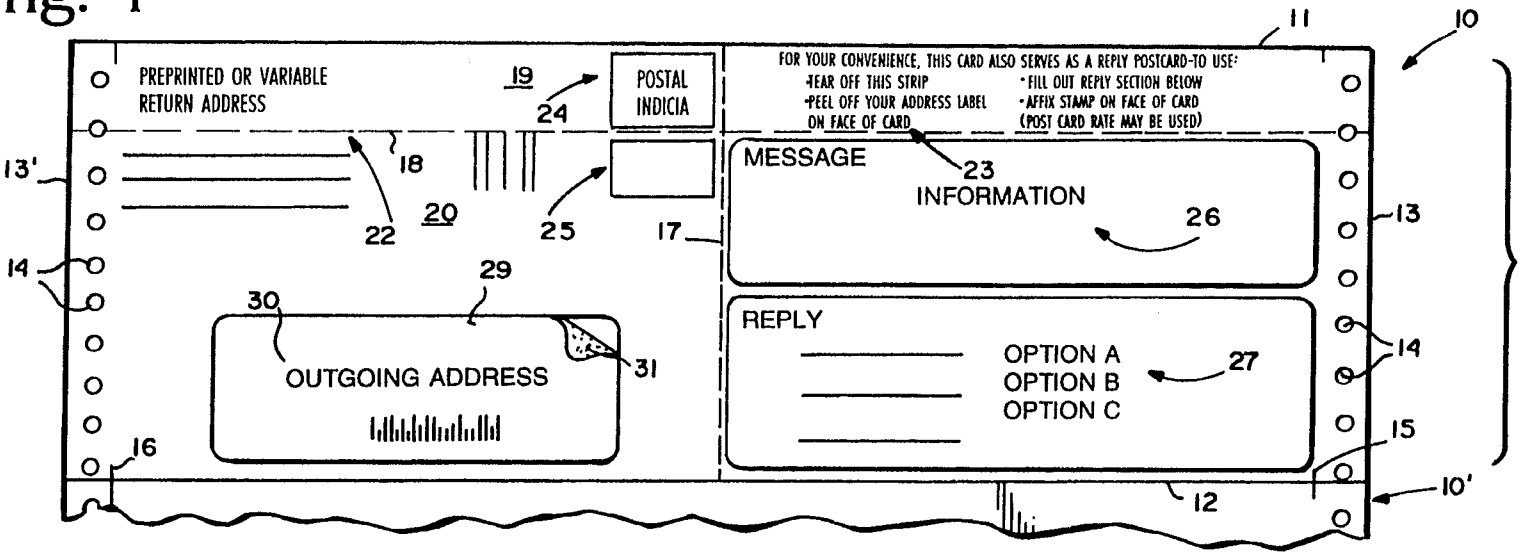
FIG. 1 is a top plan view of an intermediate for a postcard mailer according to the present invention.
Figure 2:
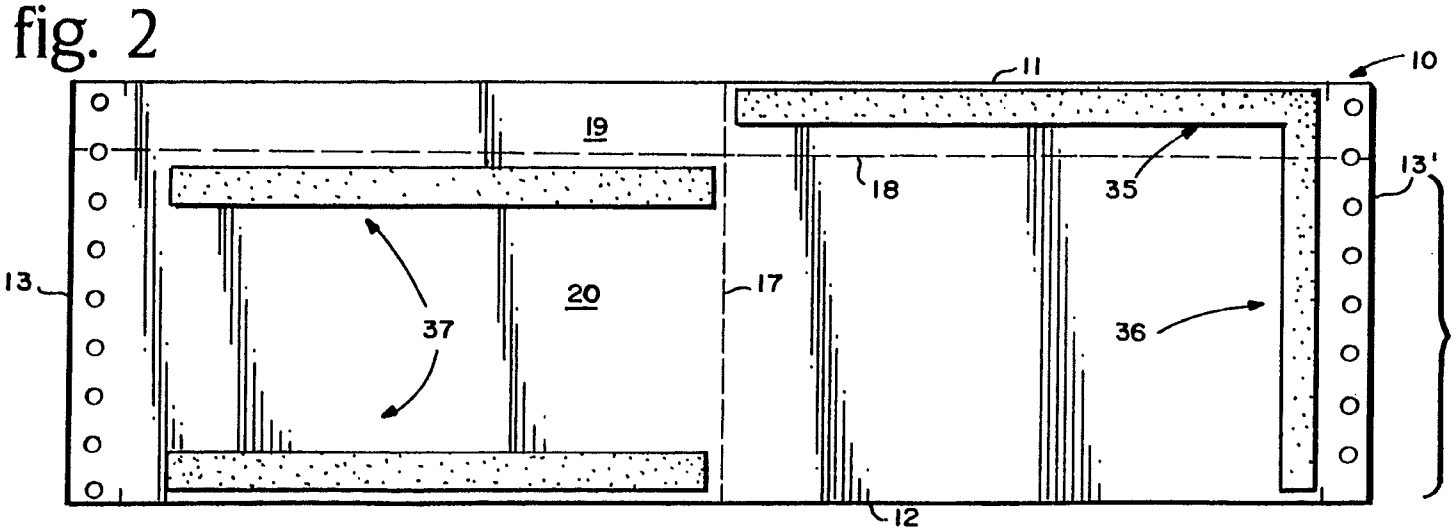
FIG. 2 is a bottom plan view of the intermediate of FIG. 1.

An intermediate 10 according to the present invention is seen in FIGS. 1 and 2. FIG. 1 illustrates the top face of the intermediate 10, on which printing is practiced, while FIG. 2 illustrates the bottom face on which adhesive is utilized.

Figure 3:
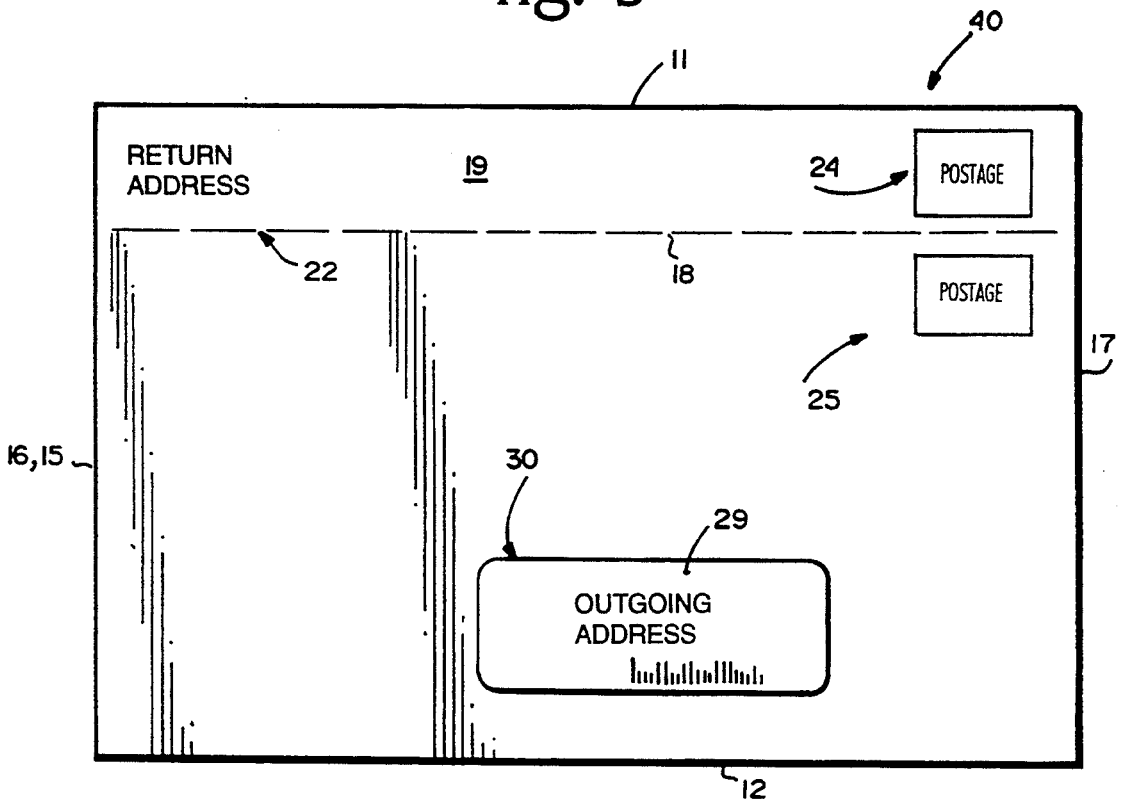
FIG. 3 is a top plan view of a postcard mailer constructed from the intermediate of FIGS. 1 and 2, in its outgoing configuration.

The intermediate 10 has a top edge 11 and a parallel bottom edge 12. The intermediate 10 may be part of a continuous form, as illustrated by the intermediate 10' partially illustrated in FIG. 1, in which case the edges 11, 12 are at one time perforation lines before the intermediate 10 is detached from the continuous format into a separate sheet, as illustrated in FIG. 2. The intermediate 10 also comprises side edges 13, 13' which typically additionally—during printing—have tractor drive openings 14 adjacent thereto. In normal use, the tractor drive hole containing portions are slit off, for example at the slit lines 15, 16 as illustrated in FIG. 1. The slit lines 15, 16 thus ultimately become the side edges of either the intermediate 10, or the final mailer (see FIGS. 3 and 4).

The intermediate 10 also includes a fold line 17, which may be a score line, a perforation line, or the like, which substantially bisects the top and bottom edges 11, 12 and extends parallel to the side edges 13, 13'. The intermediate 10 also comprises a line of weakness 18, e.g. a perforation line, which is parallel to but spaced from the top edge 11 a distance sufficient for a return address (22) to be provided between the top edge 11 and the perforation line 18. Note that the perforation line divides the sheet of paper forming the intermediate 10 into two panels, a first panel 19 between the top edge 11 and the perforation line 18, and a second panel 20 between the perforation line 18 and the bottom edge 12. The first panel 19 has sufficient width for the return address 22, while the panel 20 has a width (the distance between line 18 and bottom edge 12) at least equal to the minimum width of a mailable postcard, and has a length (the distance between the fold line 17 and each of the edges 15, 16) at least the minimum length of a postcard.

Note that the paper forming the intermediate 10 has a weight (the term "weight" as used in the specification and claims means pounds per surface area) which is at least half of the minimum weight for a postcard, but less than the minimum weight for a postcard, e.g. 24# (pounds per 17"×22" ream) ledger paper.

The return address 22 imaged on the top face of the intermediate 10 on the left side of the fold line 17 in panel 19 may be preprinted, or may be variably imaged when other indicia is being imaged on the intermediate 10. Normally the intermediate 10 will be fed through a simplex printer (e.g. a laser printer, impact printer or the like) and the instructional indicia 23 will be imaged in the panel 19 on the right side of the foldsline 17, and first and second postage indicating indicia 24, 25 may be imaged in the first panel 19 and second panel 20, respectively, on opposite sides of the perforation line 18, on the left side of and immediately adjacent the fold line 17. Also informational indicia 26 and/or inquisitive indicia 27, is printed on the second panel 20 on the right side of the fold line 17.

On the second panel 20 on the left side of the fold line 17 is a removable label 29, having outgoing address indicia 30 imaged on the top face thereof, and repositional adhesive 31 (or a like removable adhesive) on the bottom face thereof. The label 29 covers reply address indicia 32 imaged directly on the top face of the panel 20 left side (see FIG. 4), or on another label (not shown) underlying the label 29.

In the construction of a mailer from the intermediate 10, the intermediate 10 will be folded about the fold line 17. Some means is necessary to hold the intermediate 10 in that folded over condition. The means for accomplishing that function preferably comprises an adhesive pattern such as illustrated in FIG. 2, provided on the bottom face of the intermediate 10. For example a first pattern 35 is provided on the first panel 19 including a portion thereof extending in a strip adjacent the top edge 11, and another portion extending adjacent the side edge 16. A separate adhesive pattern is provided for the second panel 20, such as the strip 36 which is a continuation of the side extending portion of the first panel strip 35, and a pair of strips 37 extending just below the perforation line 18 and just above the bottom edge 12. For ease of application, the strips 37 are typically provided on one side of the fold line 17, while the patterns 35, 36 are provided on the other side, as illustrated in FIG. 2.

From the intermediate 10, the outgoing postcard mailer 40 (see FIG. 3) is constructed. The outgoing postcard mailer 40 is formed first by cutting off the tractor drive strips 14 to provide the side edges 15, 16, then folding the intermediate 10 about the fold line 17 so that the two portions of the back face (see FIG. 2) of the intermediate 10 on either side of the fold line 17 come in face-to-face contact with each other, and then passing the folded over intermediate through a machine to activate the adhesive of the adhesive strips 35–37. Typically the adhesive strips 35-37 are heat seal adhesive, in which case the intermediate is passed through a heat sealer. However the strips 35–37 may instead comprise rewettable adhesive or pressure activated cohesive.

During the method of construction of the mailer 40 from the intermediate 10, the removable label 29 may be applied at any appropriate juncture once the reply address 32 is imaged onto the top face of the panel 20.

When postage is applied to the outgoing postcard mailer, at the indicia area 24, it is sent to the outgoing addressee, indicated by the indicia 30. Since the mailer 40 is a double thickness of the paper forming the intermediate 10, it has appropriate postcard weight, although it was easily passed through a conventional printer to be imaged, and it also has minimum postcard length and width dimensions.

Figure 4:
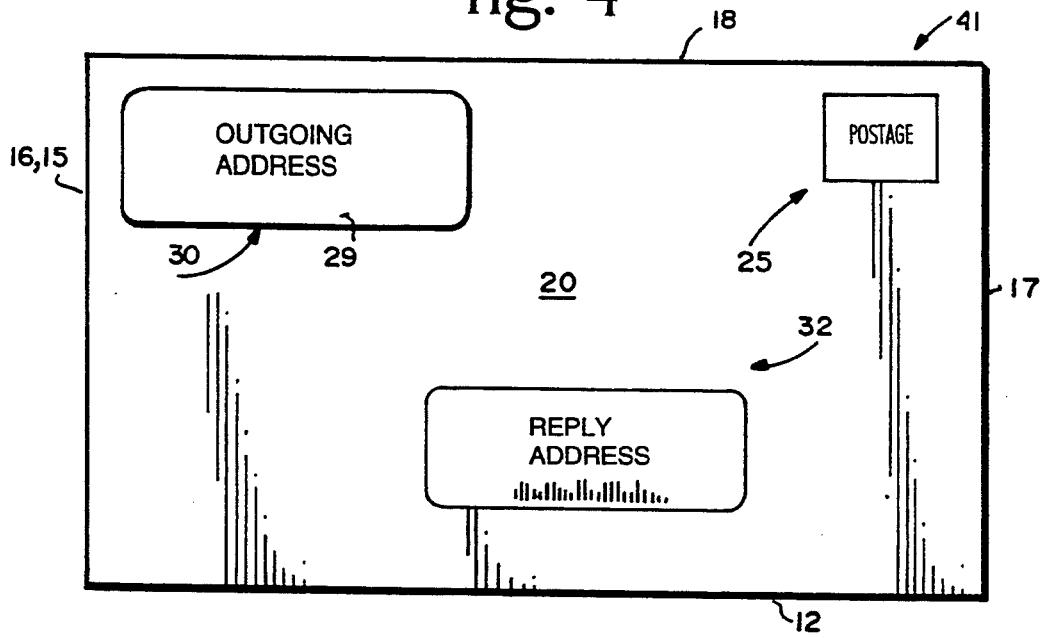
FIG. 4 is a top plan view of the postcard mailer according to the invention in its reply configuration.

When the outgoing postcard 40 is received by the addressee indicated by the outgoing address 30, he or she follows the instructions 23 on the rear face of the postcard 40, and then detaches the return address area 22 (the first panel 19) at the perforation line 18, and removes the removable label 29, to provide the reply postcard 41 illustrated in FIG. 4. Removal of the label 29 exposes the reply address 32. If desired, the removable label 29 may be provided on the return address area of the reply postcard 41, as illustrated in FIG. 4. Once postage is applied at the postage indicating indicia 25, the reply postcard 41 may be mailed to the reply addressee indicated by the reply address 32. The reply postcard 41 has sufficient weight to act as a postcard due to the double thickness of the intermediate 10 that forms it, plus it has at least the minimum width and length for a postcard; typically reply postcard 41 has a width of about 3½ inches, and a length of about 6 inches.

It will thus be seen that according to the present invention an advantageous intermediate for a postcard mailer, an advantageous postcard mailer having a reply configuration, and a method of making a postcard mailer from a sheet of paper having a weight less than the weight of a postcard, have been provided. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and methods.

What is claimed is:

1. An intermediate for a postcard mailer, comprising:

a sheet of paper having a weight less than the weight of a postcard, but at least half the weight of a postcard, having first and second faces, and having parallel top and bottom edges, and parallel first and second side edges, the lengths of each of said side edges being longer than the minimum width of a postcard, and the length of each of said top and bottom edges being at least twice the minimum length of a postcard;

a fold line parallel to said side edges and substantially bisecting said top and bottom edges;

a line of weakness parallel to said top and bottom edges and located closer to said top edge than said bottom edge to define a first panel between said top edge and said line of weakness, and a second panel between said bottom edge and said line of weakness, said first panel having a width large enough to have return address or postage indicia provided and readily legible thereon, and said second panel having a width at least as great as the minimum width of a postcard;

a first adhesive pattern provided on said second face of said first panel for holding the top and side edges of said first panel together when said sheet is folded about said fold line; and a second adhesive pattern provided on said second face of said second panel for holding the top, side, and bottom edges of said second panel together when said sheet is folded about said fold line, even if said first panel is removed by detachment along said line of weakness.

2. An intermediate as recited in claim 1 further comprising tractor drive holes provided along said side edges, the length of each of said top and bottom edges, minus the widths of both sets of tractor drive holes, being at least as great as the minimum length of a postcard.

3. An intermediate as recited in claim 1 wherein said side edges are solid, being free of tractor drive holes.

4. An intermediate as recited in claim 1 further comprising outgoing address indicia imaged on said second panel first face on a first side of said fold line.

5. An intermediate as recited in claim 4 wherein said outgoing address indicia is imaged on a removable label disposed on said second panel first face; and further comprising reply address indicia imaged directly on said first face of said second panel beneath said removable label.

6. An intermediate as recited in claim 5 further comprising return address indicia imaged on said first panel first face on said first side of said fold line.

7. An intermediate as recited in claim 6 further comprising instructional indicia for instructing the recipient of a postcard mailer made from said intermediate how to use the mailer as a reply postcard, imaged on said first panel first face on a second side of said fold line, opposite said first side.

8. An intermediate as recited in claim 1 wherein said first adhesive pattern comprises a strip of heat seal or other adhesive along said top edge on a first side of said fold line, and along said first side edge in said first panel; and wherein said second adhesive pattern comprises a continuation of said first adhesive pattern along said first side edge into said second panel, and first and second strips of heat seal adhesive adjacent said bottom edge and said line of weakness in said second panel, and parallel to said bottom edge.

9. An intermediate as recited in claim 8 wherein said first and second strips of adhesive on said second panel second face are on a second side of said fold line, opposite said first side.

10. An intermediate as recited in claim 1 further comprising reply address indicia imaged on said first face of said second panel on a first side of said fold line, and return address indicia imaged on said first face of said first panel on said first side of said fold line.

11. An intermediate as recited in claim 10 further comprising first and second indicia portions indicating where postage should be placed, said first indicia portion on said first panel first face on said first side of said fold line and next to said fold line, and said second indicia portion immediately below said first indicia portion in said second panel.

12. An intermediate as recited in claim 11 further comprising a label with repositional adhesive on a bottom face thereof, and an outgoing address imaged on a top face thereof, disposed over said reply address.

13. An intermediate as recited in claim 10 further comprising informational or inquisitive indicia imaged on said first face of said second panel on said second side of said fold line.

14. A postcard mailer comprising:

a first ply having a length and width at least equal to the minimum length and width of a postcard, and a weight at least one half the minimum weight of a postcard, but less than the minimum postcard weight; and having parallel top and bottom edges and parallel first and second side edges;

a second ply having a length and width substantially equal to that of said first ply, and a weight at least one half the minimum weight of a postcard but less than the minimum weight of a postcard; and having top, bottom, and side edges substantially in alignment with the corresponding edges of said first ply;

a line of weakness extending parallel to said top edge and defining said plies into first and second panels, a first panel of each ply between said top edge and said line of weakness, and a second panel of each ply between said line of weakness and said bottom edge, said second panel having at least a postcard minimum length and width;

means for holding said first panel of said first ply to said first panel of said second ply, and means for holding said second panels of said first and second plies together independent of said first panels;

a removable label having outgoing address indicia imaged thereon disposed on said top face of said first ply second panel; and reply address indicia underneath said label, and exposed when said label is removed.

15. A postcard mailer as recited in claim 14 further comprising return address indicia on said first face of said first ply first panel, and informational or inquisitive indicia on said bottom face of said second ply second panel.

16. A postcard mailer as recited in claim 15 further comprising instructional indicia on said bottom face of said second ply first panel, instructing the recipient on how to use the mailer as a reply postcard.

17. A postcard mailer as recited in claim 15 further comprising postage placement indicia provided on both said top face of said first ply adjacent the right side edge thereof on opposite sides of said line of weakness.

18. A postcard mailer as recited in claim 14 wherein said means for holding said plies together comprise a first adhesive pattern acting between said bottom face of said top ply and said top face of said bottom ply of said first panels, and a second adhesive pattern acting between said bottom face of said top ply and said top face of said bottom ply of said second panels.

19. A postcard mailer as recited in claim 14 wherein said reply address indicia is imaged directly on said top face of said first ply beneath said removable label.

20. A method of making a postcard mailer from a sheet of paper having a weight at least one half the minimum weight of a postcard, but less than the minimum postcard weight, the paper having leading and trailing edges, and side edges, the distance between the side edges being at least twice as great as the minimum length of a postcard, and the distance between the leading and trailing edges being at least as great as the minimum width of a postcard, and having top and bottom faces, said method comprising the steps of:

(a) providing a fold line in the sheet substantially bisecting the leading and trailing edges, and parallel to the side edges;

(b) imaging reply address indicia and return address indicia on the top face on a first side of the fold line, imaging informational or inquisitive indicia on the top face on a second side of the fold line, opposite the first side;

(c) providing a line of weakness in the sheet parallel to the leading and trailing edges and defining each side of the fold line into first and second panels, the first panel on the first side having the return address indicia imaged thereon, and the second panel on the first side having the reply address information imaged thereon, and the second ply on the second side having the informational or inquisitive indicia imaged thereon, (d) providing first and second patterns of adhesive on the bottom face of the first and second panels, respectively;

(e) imaging an outgoing address on a removable label;

(f) placing the removable label over the reply address;

(g) subsequent to steps (a), (b), and (d), folding the sheet about the fold line to bring the bottom faces of the panels on the opposite sides of the fold lines into engagement with each other; and (h) sealing the adhesive of the adhesive patterns to form an outgoing postcard which may be transformed into a reply postcard by tearing along the line of weakness and removing the label.

21. A method as recited in claim 20 wherein the sheet is part of a continuous form, having tractor drive openings along the side edges thereof; and comprising the further steps of slitting off the tractor drive opening portions along the side edges, and separating the sheet from the continuous form at the leading and trailing edges thereof.

22. A method as recited in claim 20 wherein step (b) is further practiced to image instructional indicia telling the recipient how to use the mailer as a reply postcard, on the top face of the first panel on the second side of the fold line.

23. A method as recited in claim 22 wherein step (b) is further practiced to image postage-receiving indicating indicia on the top face of the first side of the fold line on both the first and second panels, immediately adjacent the line of weakness.

* * * * *